US007373796B2

(12) United States Patent
Kubota et al.

(10) Patent No.: US 7,373,796 B2
(45) Date of Patent: May 20, 2008

(54) AUTOMATIC RELEASING-TYPE ROLLING HEAD FOR FORMING TAPERED THREAD ON PIPE

(75) Inventors: Toshifumi Kubota, Higashiosaka (JP); Masaaki Maruyama, Kyoto (JP); Hideyuki Aiura, Higashiosaka (JP); Makoto Sakaguchi, Ikoma (JP)

(73) Assignee: Rex Industries Co., Ltd., Osaka-shi (JP)

( * ) Notice: Subject to any disclaimer, the term of this patent is extended or adjusted under 35 U.S.C. 154(b) by 185 days.

(21) Appl. No.: 10/564,348

(22) PCT Filed: Dec. 4, 2003

(86) PCT No.: PCT/JP03/15554

§ 371 (c)(1),
(2), (4) Date: Jan. 12, 2006

(87) PCT Pub. No.: WO2005/007315

PCT Pub. Date: Jan. 27, 2005

(65) Prior Publication Data

US 2006/0162411 A1 Jul. 27, 2006

(30) Foreign Application Priority Data

Jul. 16, 2003 (JP) ..... 2003-197931

(51) Int. Cl.
*B21H 3/04* (2006.01)
*B21K 1/44* (2006.01)

(52) U.S. Cl. ..... 72/104; 72/121; 470/76; 470/83; 408/149; 408/177

(58) Field of Classification Search ..... 408/15, 408/73, 148, 149, 176, 177; 72/102, 103, 72/104, 108, 121; 470/66, 67, 73, 75, 76, 470/77, 83, 200, 201
See application file for complete search history.

(56) References Cited

U.S. PATENT DOCUMENTS 4,288,181 A * 9/1981 Sakaguchi et al. ..... 408/15
4,329,093 A * 5/1982 Maruyama ..... 408/15
5,199,928 A * 4/1993 Gress et al. ..... 470/75
5,699,691 A 12/1997 Maruyama

FOREIGN PATENT DOCUMENTS

| | | |
|---|---|---|
| JP | 06-179030 | 6/1994 |
| JP | 10-34270 | 2/1998 |
| JP | 2003-126937 | 5/2003 |

* cited by examiner

*Primary Examiner*—Ed Tolan
(74) *Attorney, Agent, or Firm*—Morrison & Foerster LLP

(57) ABSTRACT

The invention is aimed at the provision of an automatic releasing-type rolling head for forming a tapered thread on a pipe in which the shock generated at the end of the thread rolling operation is alleviated and a thread automatic rolling roller retracting mechanism is not damaged. The rolling head includes shaft bearing plates 33 which are slidably supported in a plurality of guide grooves 36 radially provided on inner surfaces of the front and rear closures of the housing 30 and which are provided on their outer surfaces in the radial directions with oblique surfaces 33*b*, thread rolling rollers 35 rotatably supported by the shaft bearing plates 33, a cam ring 31 which rotates in the housing 30 and has cam oblique surfaces 31*a* opposed to the oblique surfaces 33*b* of the shaft bearing plates 33, a lever 44 which abuts at its oblique surface against a cam member 45 to prevent movement thereof in association with the cam ring 31 and an abutment member 41 which is pressed and moved by a thread-rolled pipe. When the to-be-rolled pipe is thread-rolled to a predetermined length, the oblique surface of the lever 44 moving in association with the movement of the abutment member 41 is gradually moved away from the cam member 45. The cam ring 31 is rotated and the shaft bearing plates 33 and the thread rolling rollers 35 are moved in radial and outward directions and released from the to-be-rolled pipe.

7 Claims, 11 Drawing Sheets

AUTOMATIC RELEASING-TYPE ROLLING HEAD FOR FORMING TAPERED THREAD ON PIPE

This application is a 35 USC 371 of PCT/JP03/15554 filed Dec. 4, 2003.

FIELD OF THE INVENTION

This invention relates to an automatic releasing-type rolling head for forming a tapered thread on a pipe. Especially, this invention relates to an automatic releasing-type rolling head for forming a tapered thread on a pipe, in which a tapered thread is formed on a steel pipe for piping by rolling and the rolling rollers are automatically released from the to-be-rolled pipe after the rolling operation is completed.

PRIOR ART

Conventionally, when steel pipes for piping are connected through a pipe joint, a tapered thread is formed on an end of the steel pipe. There are known two tapered thread-forming methods, i.e., a cutting method and a plastic deformation forming method. The plastic deformation forming is carried out, for example, by a thread-rolling method using thread-forming rollers. FIGS. 10 to 12 show an example of a thread-rolling head which is used in the thread rolling method. The thread rolling head shown in FIGS. 10 to 12 comprises a thread rolling mechanism, an automatic rolling roller retracting mechanism, a thread diameter adjusting mechanism and a mechanism for cutting an outer diameter of a to-be-rolled pipe.

As shown in FIGS. 10 and 11, the thread rolling mechanism has a housing 1 and a plurality of thread rolling rollers 2. The housing 1 is comprised of a front closure 1*a*, a rear closure 1*b* and a cylindrical intermediate part 1*c* through which the front closure 1*a* and the rear closure 1*b* are connected to each other. The intermediate part 1*c* is provided with a cam ring 3 which rotates in contact with the inner surface of the intermediate part 1*c*. Roller shafts 4 are inserted in the center holes of each thread rolling roller 2. Both ends of the roller shafts 4 are supported by rectangular shaft bearing plates 5 which are supported slidably in recessed grooves 6 radially provided in the inner surfaces of the front closure 1*a* and the rear closure 1*b*. The roller shafts 4 are supported at an angle corresponding to a lead angle of a thread to be rolled.

As shown in FIG. 12, the shaft bearing plates 5 are provided, at their surfaces opposed to the cam ring 3, with oblique surfaces 5*a*. The cam ring 3 is provided, at its inner surface, with cam surfaces 3*a* corresponding to the oblique surfaces 5*a* of the shaft bearing plates 5 and slots 3*b* parallel with the cam surfaces 3*a*. Pins 5*b* which are engaged in the slots 3*b* are provided in the vicinity of the oblique surfaces of the shaft bearing plates 5.

As shown in FIG. 11, the automatic rolling roller retracting mechanism has an abutment member 8 which is pressed and moved by a to-be-rolled pipe 7 during a thread-rolling operation and which is slidably provided in the rear closure 1*b*, a fan-shaped first lever 9 pivoted by the abutment member 8 and pivotably supported by a pin 9*a*, a second lever 10 pivoted by the first lever 9 and pivotably supported by a pin 10*a*, and a rod 14, which is pressed by the second lever 10 and is moved in a guide cylinder 11 and which has a roller 12 at its front end and a thread length adjusting screw 13 at its rear end, provided in the rear closure 1*b*. An arm 15 for rotating the cam ring 3 is secured to the cam ring 3 and is provided with an eccentric cam 16 which is in contact with the roller 12 and which can be pivoted by a knob 16*a*.

In the mechanism for cutting the outer diameter of the to-be-rolled pipe, as shown in FIGS. 10 and 11, a shaft 18 is rotatably supported, in a hole 17 provided in parallel with the center line of the head, on the side part of the front closure 1*a*. A cylindrical outer diameter cutting portion 20 is provided to an outer diameter cutting portion supporting arm 19 supported by the shaft 18 through a hinge pin (not shown), so that the outer diameter cutting portion 20 can be positioned in front of and at the center of the front closure 1*a*.

When the to-be-rolled pipe 7 is inserted in the outer diameter cutting portion 20 while being rotated in a state shown in FIG. 11, the outer diameter of the pipe 7 can be cut. Thereafter, the outer diameter cutting portion 20 is rotated about the shaft 18 in the lateral direction of the head, and is rotated about the hinge pin (not shown) and is retracted rearward. After that, the to-be-rolled pipe 7 is moved in the direction of an arrow "A", while being rotated, and is inserted among the thread rolling rollers 2, so that a tapered thread is formed on the outer periphery of the pipe.

When the pipe is further rolled to press and move the abutment member 8, the first lever 9 is pivoted in the direction of an arrow "B" and the second lever 10 is pivoted in the direction of an arrow "C" and, then, the rod 14 is moved in the direction of an arrow "D" by the second lever 10. When the roller 12 provided at the front end of the rod 14 is released from the eccentric cam 16, a spring 3*c* pulls the arm 15 and the cam ring 3, and the arm 15 is pivoted in the direction of an arrow "E", as shown in FIG. 12. The movement of the cam surfaces 3*a* of the cam ring 3 causes the plurality of shaft bearing plates 5 to move in the widening direction, through the pins 5*b* which are guided in the slots 3*b*. Consequently, since the plurality of thread rolling rollers 2 are moved outward, the thread of the thread rolling rollers 2 are disengaged from the thread of the to-be-rolled pipe 7 so that the to-be-rolled pipe 7 can be removed without rotating the same.

By moving the thread length adjusting screw 13 forward or rearward, the timing at which the roller 12 is disengaged from the eccentric cam 16 can be adjusted to adjust the length of the thread. Also, by rotating the eccentric cam 16, the initial position of the cam ring 3 is adjusted through the arm 15 to adjust the position of the shaft bearing plates 5, so that the thread diameter can be adjusted. By way of example, see Kokai (Japanese Unexamined Patent Publication) No. 2003-126937.

In a conventional thread rolling head as mentioned above, there is a problem that the automatic rolling roller retracting mechanism is suddenly moved and displaced due to a great shock caused by the recovery of the elastic deformation in the to-be-rolled pipe when the rolling rollers are moved away from the to-be-rolled pipe, in the course of, and at the end of, the thread-rolling operation. Even if the shock is reduced, the sudden moving and displacement of the automatic rolling roller retracting mechanism must be absorbed. If a mechanism for absorbing the moving and displacement is provided, there is a problem that the to-be-rolled pipe is moved beyond a predetermined length, so that the automatic rolling roller retracting mechanism or the mechanism for receiving the sudden movement thereof may be damaged, if the automatic rolling roller retracting mechanism fails to operate at the end of the thread-rolling operation, for some reason. Also, there are problems that the miniaturization of the structure for providing the pins in the shaft bearing plates is limited in view of the strength, that foreign matters which are produced by the thread-rolling operation and which stay in the housing cannot be removed, and that the end surface of the to-be-rolled pipe, which is made rough as a result of the thread-rolling, wears the surface of the abutment member pressed and moved thereby.

An object of this invention is to provide an automatic releasing-type rolling head, for forming a tapered thread on a pipe, in which the above-mentioned problems are solved.

DISCLOSURE OF THE INVENTION

To achieve the above object, in an embodiment of the present invention comprises a cylindrical housing 30 with front and rear closures, shaft bearing plates 33 which are slidably supported in a plurality of guide grooves 36 radially provided on inner surfaces of the front and rear closures of the housing 30, said shaft bearing plates 33 being provided on their outer surfaces in the radial directions with oblique surfaces 33*b*, thread rolling rollers 35 rotatably supported by the shaft bearing plates 33 through roller shafts 34, a cam ring 31 which rotates in the housing 30 and has cam oblique surfaces 31*a* opposed to the oblique surfaces 33*b* of the shaft bearing plates 33, a lever 44 which abuts at its oblique surface against a cam member 45 to prevent movement thereof in association with the cam ring 31 and an abutment member 41 which is pressed and moved by a thread-rolled pipe, wherein the rolling load which acts the rolling rollers 35 during a thread-rolling operation is reduced due to contact friction in the course of transference of the rolling load to the cam oblique surface 45*a* of the cam member 45 and to the oblique surface of the lever 44; when the to-be-rolled pipe is thread-rolled to a predetermined length, the oblique surface of the lever 44 is gradually moved away from the cam member 45 moving in association with the cam ring 31, in association with the movement of the abutment member 41; whereby the cam ring 31 is rotated due to the rolling load so that the shaft bearing plates 33 and the thread rolling rollers 35 are moved in radial and outward directions and released from the to-be-rolled pipe. The front and rear closures of the housing 30 are not necessarily made of separate pieces but can be made integral. The oblique surfaces 33*b* of the shaft bearing plates 33 may be in the form of a circular arc.

BEST MODE FOR CARRYING OUT THE INVENTION

Figure 1:
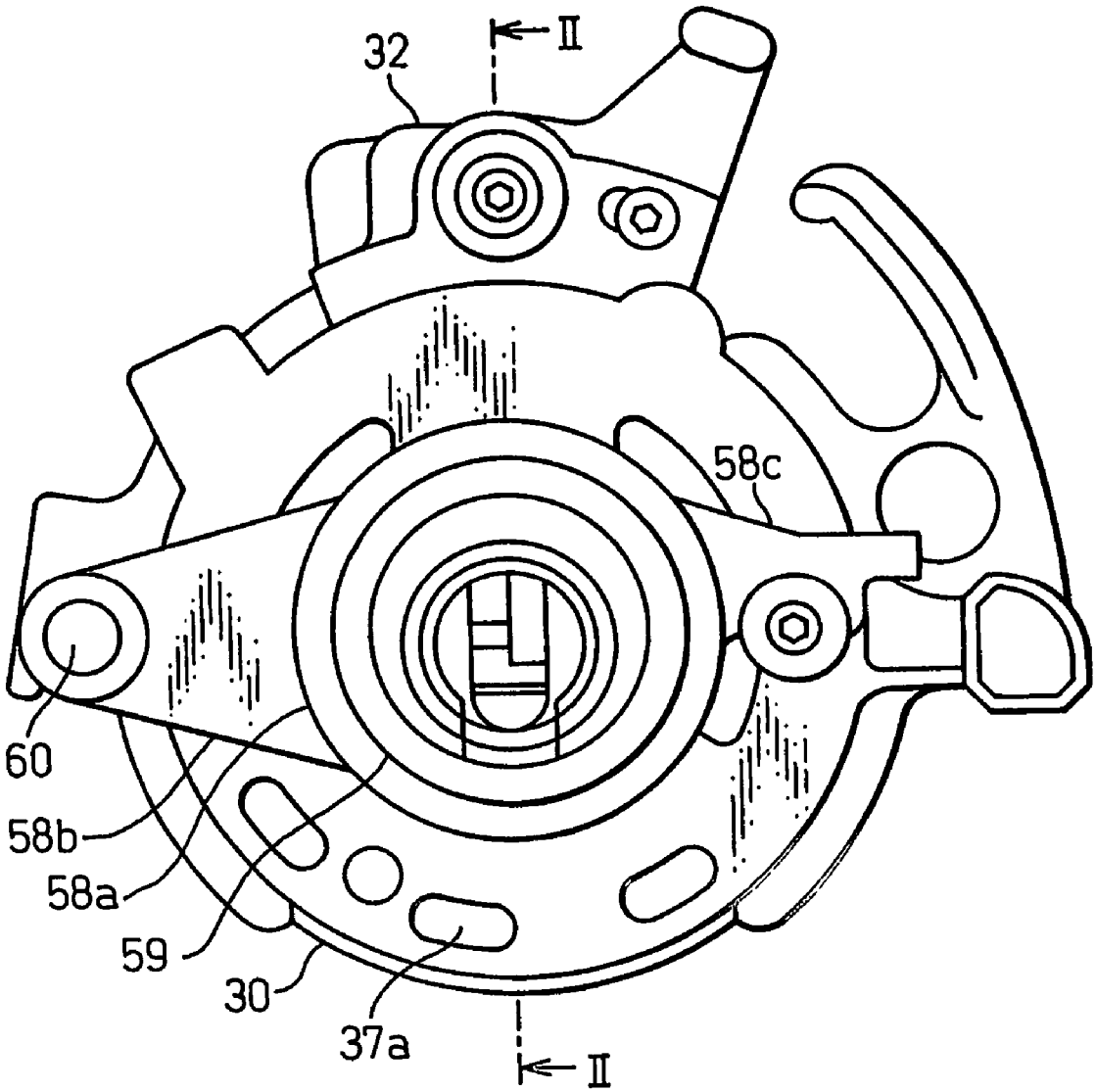
FIG. 1 is a front view of an embodiment of an automatic releasing-type rolling head for forming a tapered thread on a pipe according to the present invention.
Figure 2:
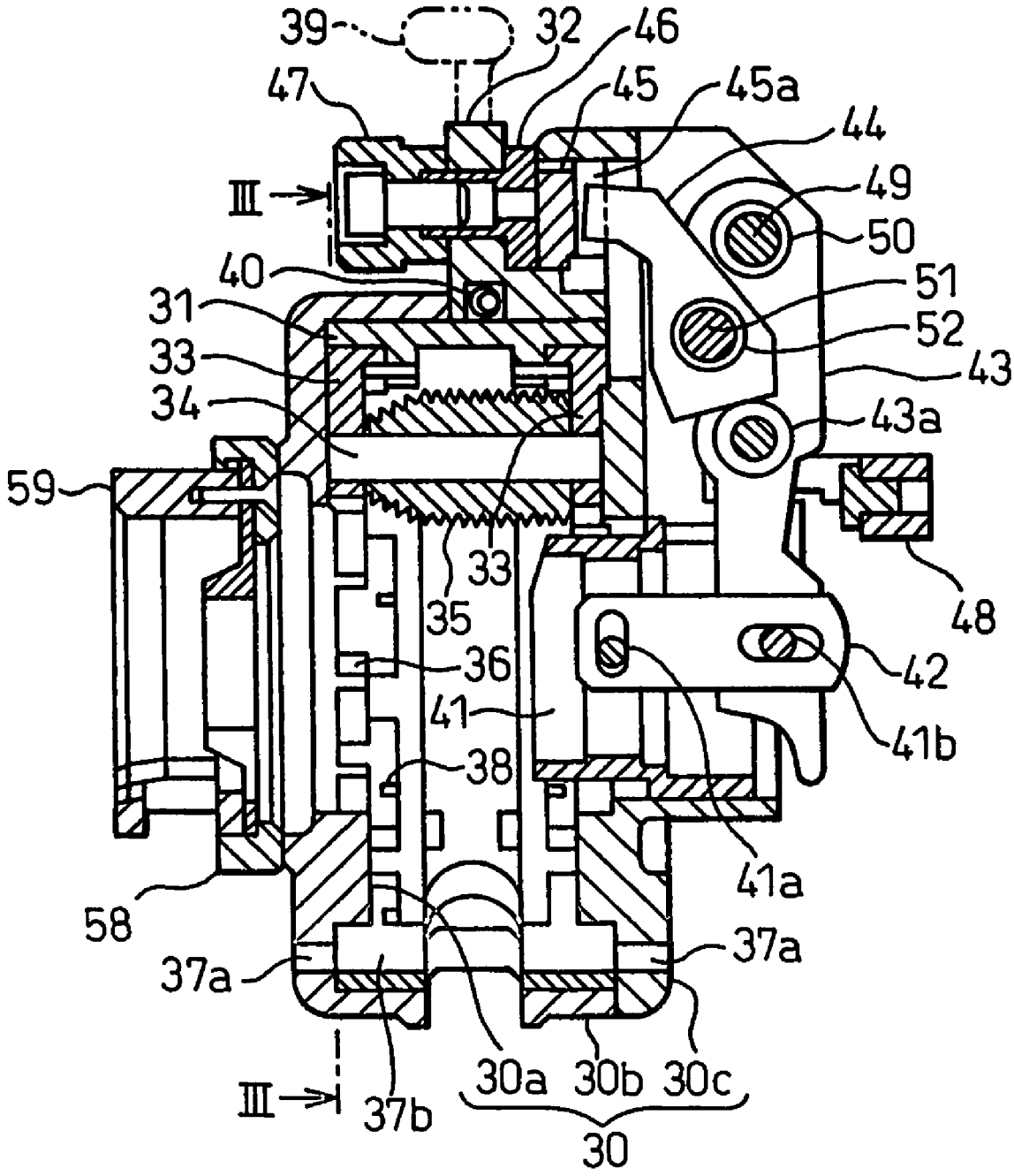
FIG. 2 is a sectional view taken along the line II-II in FIG. 1.
Figure 3:
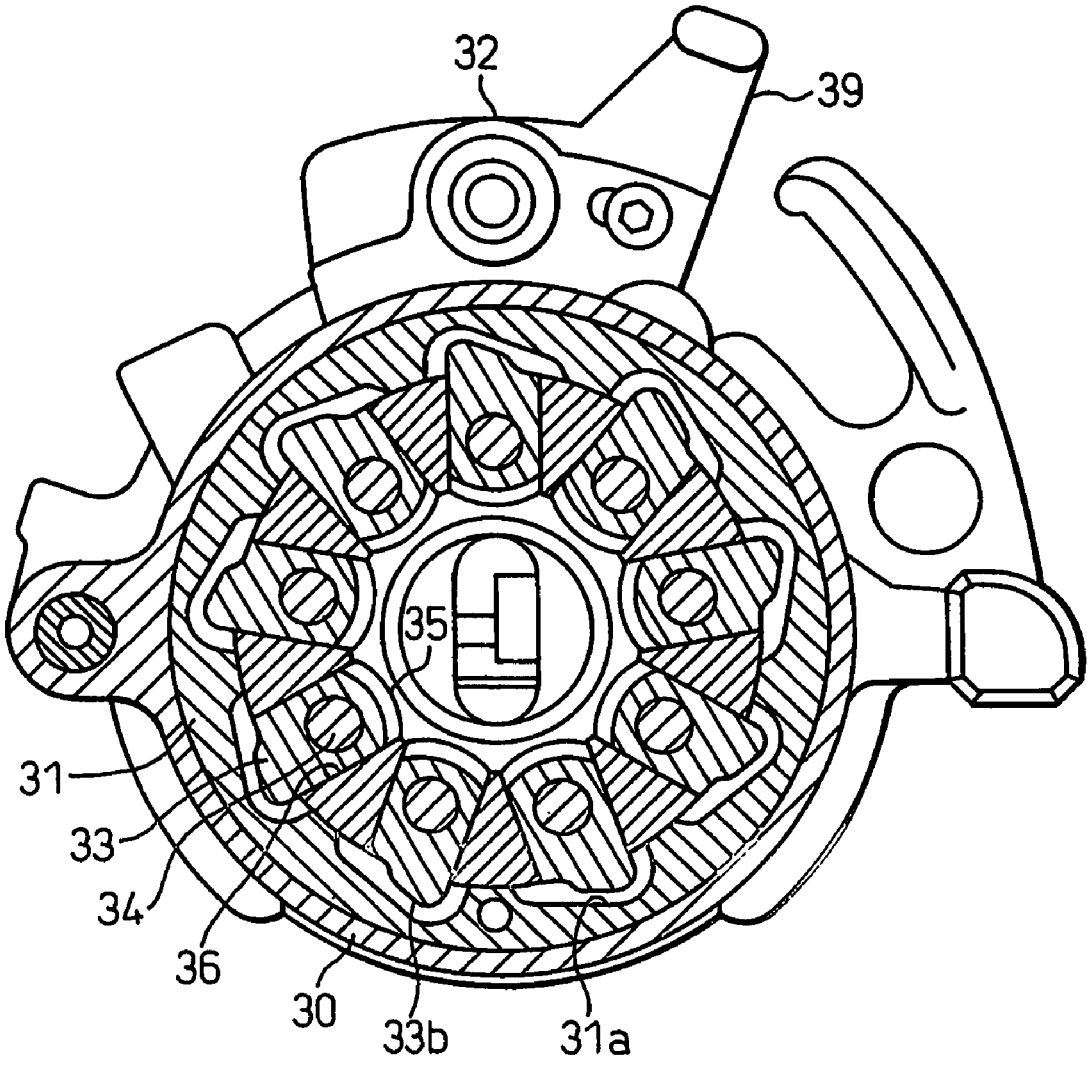
FIG. 3 is a sectional view taken along the line III-III in FIG. 2.
Figure 4:
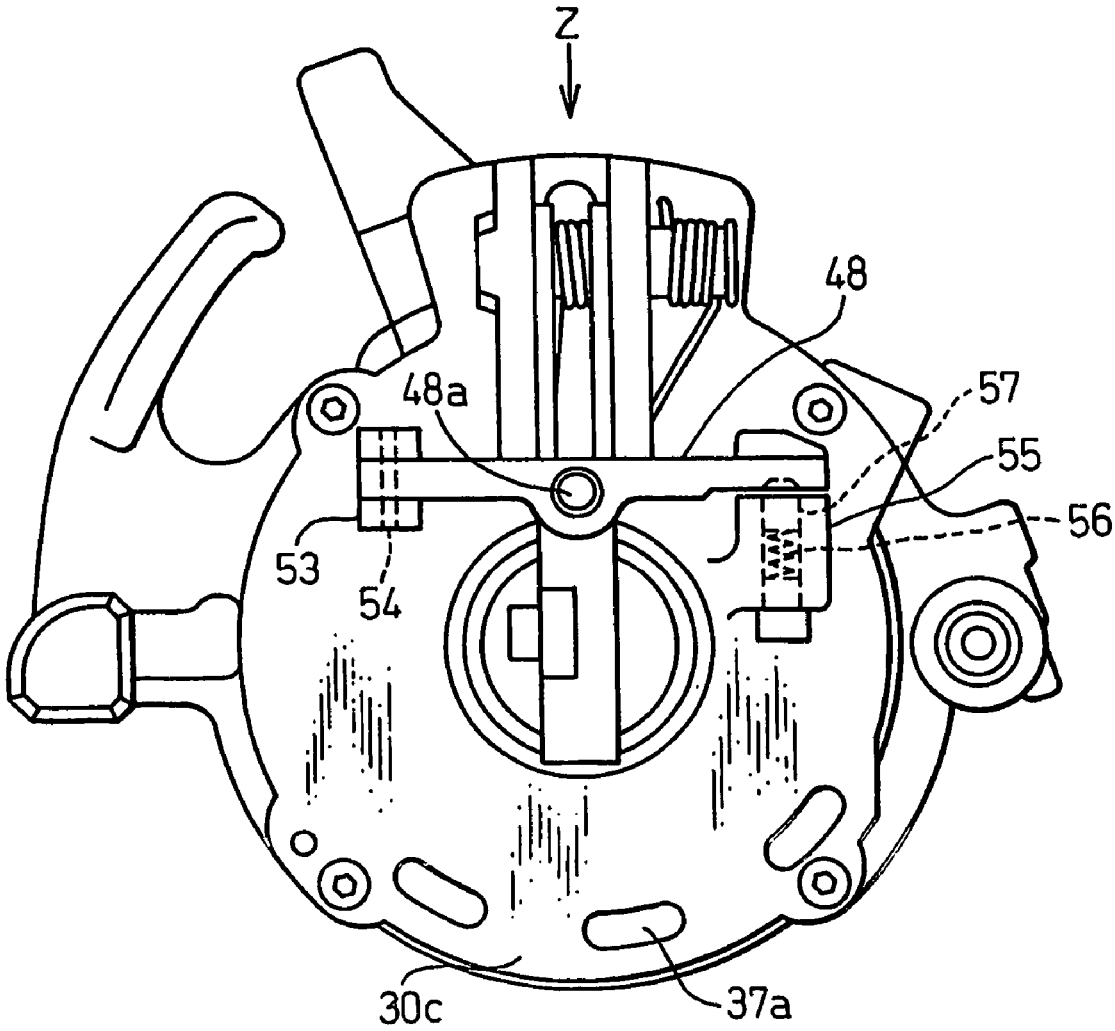
FIG. 4 is a rear view of an embodiment of an automatic releasing-type rolling head for forming a tapered thread on a pipe according to the present invention.
Figure 5:
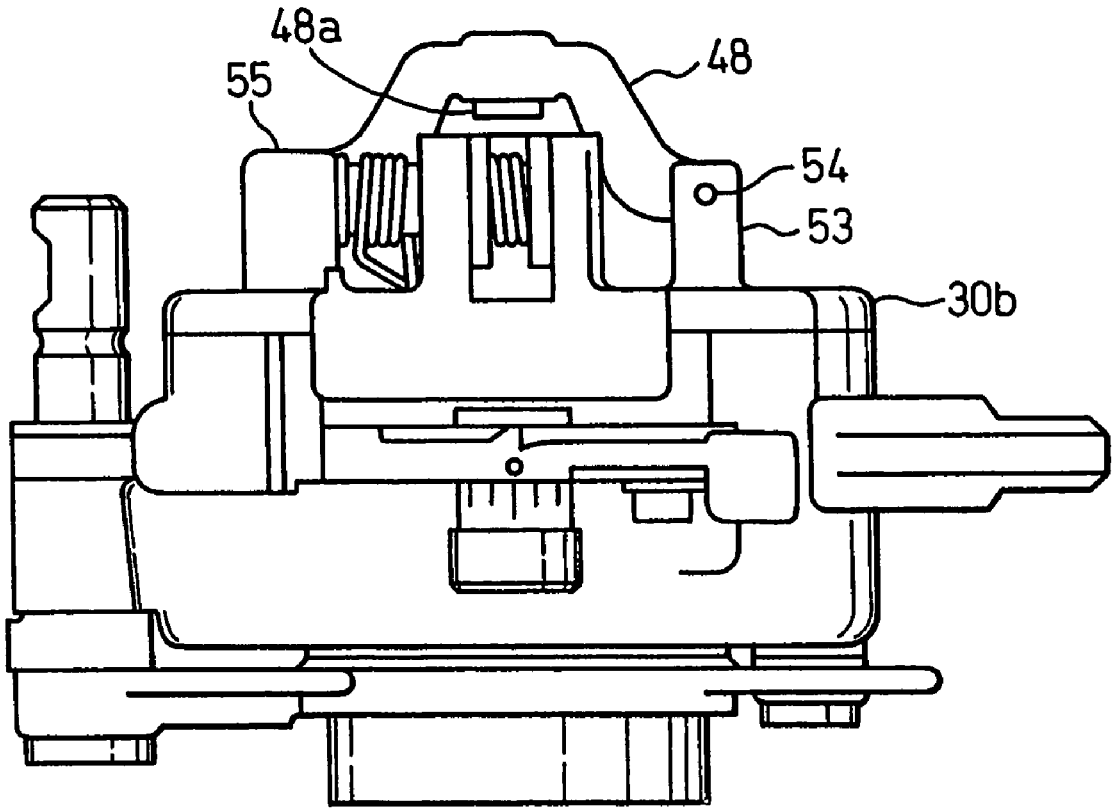
FIG. 5 is an end view viewed from the direction of an arrow "Z" in FIG. 4.

FIGS. 1 to 5 show an embodiment of an automatic releasing-type rolling head for forming a tapered thread on a pipe according to the present invention. FIG. 1 is a front view. FIG. 2 is a sectional view taken along the line II-II in FIG. 1. FIG. 3 is a sectional view take along the line III-III in FIG. 2. FIG. 4 is a rear view. FIG. 5 is an end view viewed from the direction of an arrow "Z" in FIG. 4. The present embodiment comprises a thread rolling mechanism, an automatic rolling roller retracting mechanism, and a mechanism for cutting an outer diameter of a to-be-rolled pipe.

As shown in FIGS. 2 and 3, the thread rolling mechanism comprises a housing 30, a cam ring 31 which can rotate in contact with the inner surface of the housing 30, a setting block 32 secured to the outer periphery of the cam ring 31, shaft bearing plates 33 controlled by the cam ring 31, roller shafts 34 supported by the shaft bearing plates 33 and thread rolling rollers 35.

The housing 30 is comprised of a front closure 30*a*, a cylindrical intermediate part 30*b* and a rear closure 30*c*. The front closure 30*a* and the rear closure 30*c* are provided, on their inner surfaces, with a plurality of radial guide grooves 36 (nine grooves in the illustrated embodiment) for guiding the shaft bearing plates 33. The housing 30 has, in its lower portion, a plurality of foreign matter discharge holes 37*a* (three holes in the illustrated embodiment) for discharging foreign matters, such as swarfs produced by the thread-rolling operation. The foreign matter discharge holes 37*a* are communicated to foreign matter discharge holes 37*b*, which will be described hereinafter, provided in the cam ring.

Figure 7A:
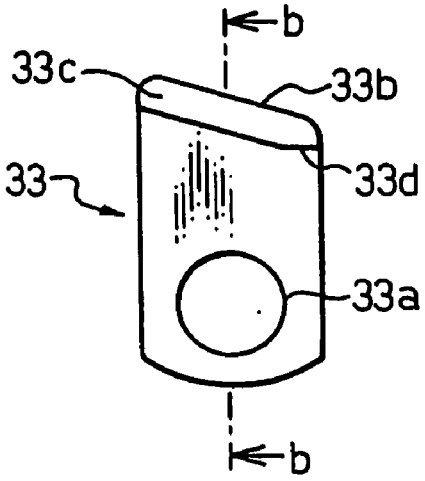
FIG. 7*a* is a front view of a shaft bearing plate in an embodiment of an automatic releasing-type rolling head for forming a tapered thread on a pipe according to the present invention.
Figure 7B:
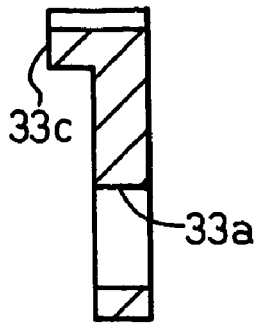
FIG. 7*b* is a sectional view taken along the line b-b in FIG. 7*a*.

Discontinuous circumferential groove type rolling rollers (Japanese Registered Patent No. 2,572,190) having a plurality of independent grooves, instead of a spiral groove, are used for the thread rolling rollers 35. The rolling rollers are supported in the shaft bearing holes 33*a* of the shaft bearing plates 33, deviated in the direction of the width of the guide grooves 36, at an inclination angle corresponding to a lead angle of a thread of a to-be-rolled pipe. As shown in FIG. 7, the substantially rectangular shaft bearing plates 33 are provided with oblique surfaces opposed to the cam surfaces of the cam ring 31 and projections 33*c* substantially in parallel with the oblique surfaces 33*b*. The surfaces of the projections 33*c*, that are located opposite to the oblique surfaces 33*b*, are provided, at their lower portions, with surfaces 33*d* in parallel with the width direction of the shaft bearing plates 33.

As shown in FIGS. 2 and 3, the cam ring 31 is cylindrically shaped so as to rotate in the interior of the housing 30, and the cam ring 31 has a setting block 32 with a lever 39, which is secured to the outer periphery thereof through a screw. Also, the cam ring 31 is provided on its inner surface with oblique cam surfaces 31*a* corresponding to the oblique surfaces 33*b* of the shaft bearing plates 33, and, in the vicinity of the cam surfaces, with pins 38 which loosely engage with the projections 33*c* of the shaft bearing plates 33 to hold the shaft bearing plates 33.

The cam ring 31 is biased, to rotate in the clockwise direction in FIG. 3, by a spring 40 which is engaged at one end with the setting block 32 and at the other end with the housing 30. The cam ring 31 is provided in the vicinity of the cam surfaces 31*a* with foreign matter discharge holes 37*b* communicated to foreign matter discharge holes 37*a* of the housing 30.

As shown in FIG. 2, the automatic rolling roller retracting mechanism comprises a cylindrical abutment member 41 which is pressed and moved by a front end of the pipe being thread-rolled and which is slidably provided on the rear closure 30*c*, a first lever 43 driven by the abutment member 41 through a pin 41*a*, a link 42 and a bolt 41*b*, a second lever 44 driven by the first lever 43, a cam member 45 supported by the setting block 32 and controlled by the second lever 44, an eccentric cam 46 which is adapted to adjust the thread diameter of the to-be-rolled pipe by adjusting the position of the cam member 45 on the setting block, a knob 47 connected to the eccentric cam 46 through a shaft, and a buffer arm 48 provided on the rear closure 30*c*.

Figure 8A:
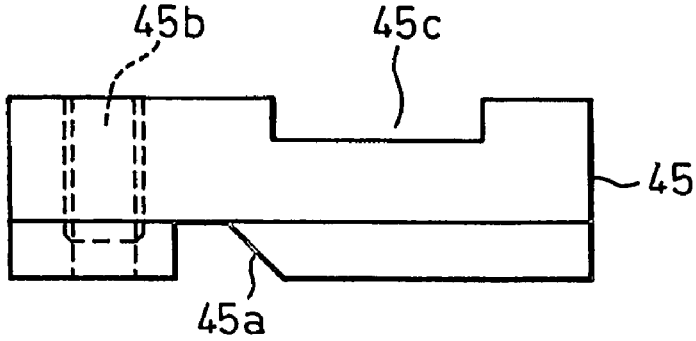
FIG. 8*a* is a top view of a cam member in an embodiment of an automatic releasing-type rolling head for forming a tapered thread on a pipe according to the present invention.
Figure 8B:
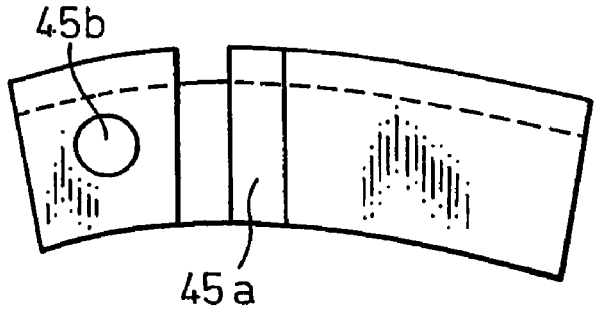
FIG. 8*b* is a front view of a cam member in an embodiment of an automatic releasing-type rolling head for forming a tapered thread on a pipe according to the present invention.

The first lever 43 having a roller 43*a* is pivotably supported by a spindle 49 and is biased by a spring 50 in the clockwise direction in FIG. 2. The second lever 44 is pivotably supported by a spindle 51 and is biased by a spring 52 in the counterclockwise direction in FIG. 2. The rear end of the second lever 44 is engaged by the roller 43*a* of the first lever 43 to restrict the rotation thereof and the front end thereof is engaged by the cam oblique surface 45*a* provided on the cam member 45. As shown in FIG. 8, the cam member 45 has a threaded hole 45*b* for securing the setting block 32, a groove 45*c* engaged by the eccentric cam 46 and a groove which defines the cam oblique surface 45*a* engaged by the second lever 44.

The lower surface 44*b* of the second lever 44, which is engaged by the roller 43*a*, is inclined upwardly in the right direction as shown in FIG. 2, so that, when the first lever 43 and the roller 43*a* rotates in the counterclockwise direction in FIG. 2; the second lever 44 in contact with the roller 43*a* rotates in the clockwise direction.

The eccentric cam 46 is connected to the thread diameter adjusting knob 47 which is rotatably provided on the setting block 32, through the shaft. The knob 47 is rotated with the set screw of the cam member 45 loosened, to rotate the eccentric cam 46, so that the position of the cam member 45 can be moved on the setting block 32.

The buffer arm 48 is located behind the first lever 43 as shown in FIGS. 4 and 5. One end of the buffer arm 48 is pivotably supported through a hinge pin 54 by a boss 53 provided on the rear closure 30*c* and the other end thereof is detachably supported by a boss 55 provided on the rear closure 30*c*, through a shutter pin 57 pressed by a spring 56. The buffer arm 48 is provided at its center portion with an elastic buffer member (rubber, etc.) 48*a*, opposed to the first lever 43.

Figure 6:
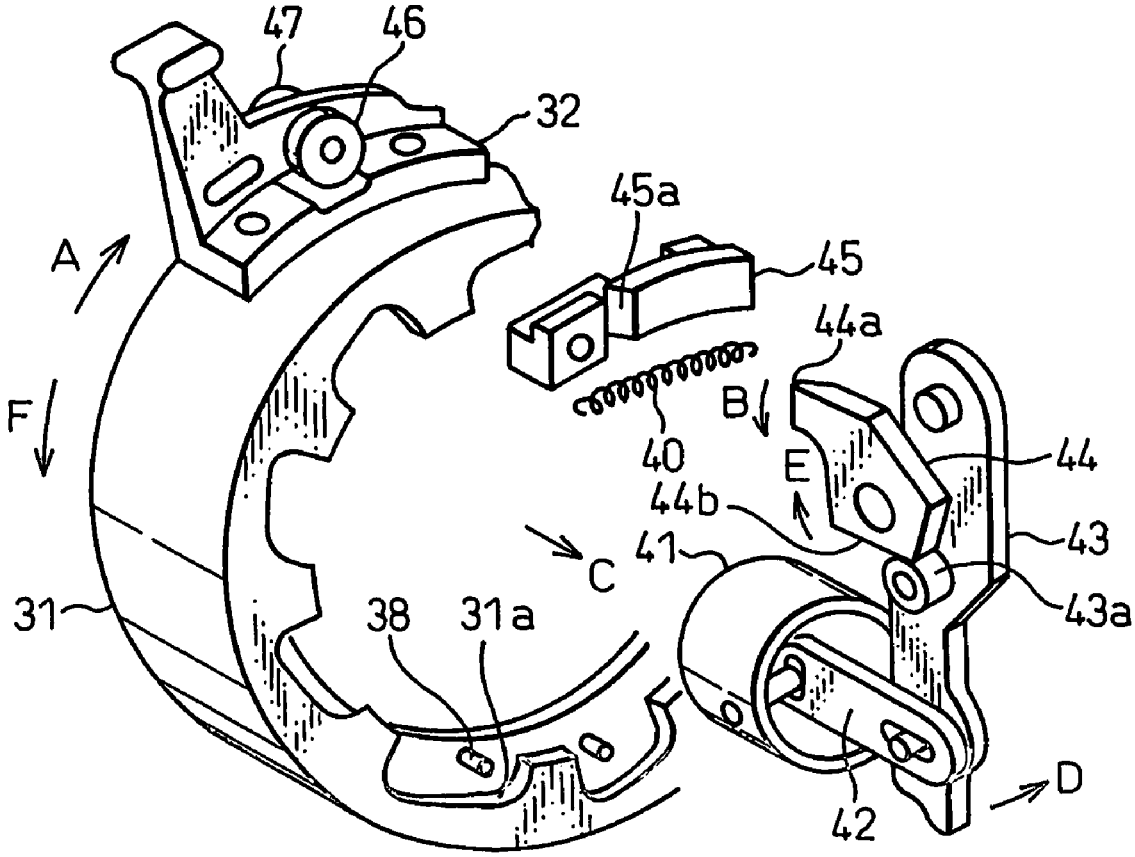
FIG. 6 is an explanatory view of an operation of an embodiment of an automatic releasing-type rolling head for forming a tapered thread on a pipe, according to the present invention.

The mode of operation of the thread rolling mechanism and the automatic rolling roller retracting mechanism, constructed as above will be explained with reference to FIG. 6.

By loosening the screw that secures the cam member 45 to rotate the thread diameter adjusting knob 47 to a predetermined position, the cam member 45 is set in a predetermined position through the eccentric cam 46 and is secured by the screw. The setting block 32 that supports the cam member 45 is rotated in the direction of an arrow "A", against the spring 40. The front end 44*a* of the second lever 44 that is biased by the spring 52 to rotate in the direction of an arrow "B", is engaged with the cam oblique surface 45*a* of the cam member 45. In this state, the cam ring 31 rotates in the clockwise direction and presses the oblique surfaces 33*b* of the shaft bearing plates 33 at the cam oblique surfaces 31*a* in order to set the shaft bearing plates 33 and the rolling rollers 35 to a position at which a predetermined thread diameter can be obtained. The abutment member 41, the link 42 and the first lever 43 are associated with the link 42 and is pivoted in the direction of an arrow "D".

When the first lever 43 pivots in the direction of an arrow "D", the second lever 44 which has been engaged to the roller 43*a* is released and pivoted, in the direction of an arrow "E", by the rolling load, and against the biasing force of the spring 50. The front end 44*a* of the second lever 44 is disengaged from the cam groove 45*a* of the cam member 45, so that the cam member 45 rotates along with the setting block 32 and the cam ring 31, by the rolling load and the biasing force of the spring 40, in the direction of an arrow "F".

The rotation of the cam ring 31 in the direction of an arrow "F" causes the shaft bearing plates 33 to be moved outward in the radial direction through the pins 38 provided on the cam ring 31, so that the thread rolling rollers 35 are retracted radially and moved away from the to-be-rolled pipe. In this way, the to-be-rolled pipe can be removed from the thread rolling head.

With this structure, when the first lever 43 is pivoted gradually in the direction of an arrow "D", the second lever 44 is pivoted gradually in the direction of an arrow "E", so that the cam ring 31 and the cam member 45 which contacts to the front end 44*a* of the second lever 44 through the cam oblique surface 45*a* are gradually rotated in the direction of an arrow "F". Consequently, the shaft bearing plates 33 in contact with the cam oblique surfaces 31*a* of the cam ring 31 are gradually moved in the radially outward direction. As a result, the thread rolling rollers 35 are gradually moved away from the to-be-rolled pipe and, thus, the rolling load is gradually reduced and the thread rolling operation ends. Therefore, a shock, as found in a conventional thread rolling head, is reduced. Further, even if the first lever 43 comes into collision with the buffer arm 48, the shock is absorbed or reduced by the elastic buffer member 48*a*.

If the thread rolling fails to stop for some reason and the to-be-rolled pipe continues to press the abutment member 41, the first lever 43 presses the buffer arm 48. However, when a certain amount of force is exerted on the buffer arm 48, the buffer arm 48 presses the shutter pin 57 at its one end and moves away from the boss 55, so that the apparatus is not damaged.

Foreign matter, such as swarf produced by the thread-rolling, can be discharged from the foreign matter discharge holes 37*a* and 37*b* provided in the housing 30 and the cam ring 31. By providing the projections 33*c*, instead of the pins in the prior art, on the shaft bearing plates 33, the strength of the shaft bearing plates 33 can be increased and, thus, miniaturization can be realized.

The to-be-rolled pipe may be inaccurate in the outer diameter or roundness, or have a rough outer peripheral surface or have a coated outer peripheral surface, thus, the outer surface must be slightly scraped in order to ensure precise thread rolling.

Referring to FIG. 1, an embodiment of the mechanism for cutting an outer diameter of a to-be-rolled pipe will be explained. In this embodiment, the mechanism comprises a scraper holder 58 and a scraper 59. The scraper holder 58 has a circular holder part 58*a* and arms 58*b*, 58*c* integral therewith, provided on the right and left sides of the holder part 58*a* to support the holder part 58*a*. The arm 58*b* is pivotably supported by the thread rolling head, through a shaft 60.

Figure 9A:
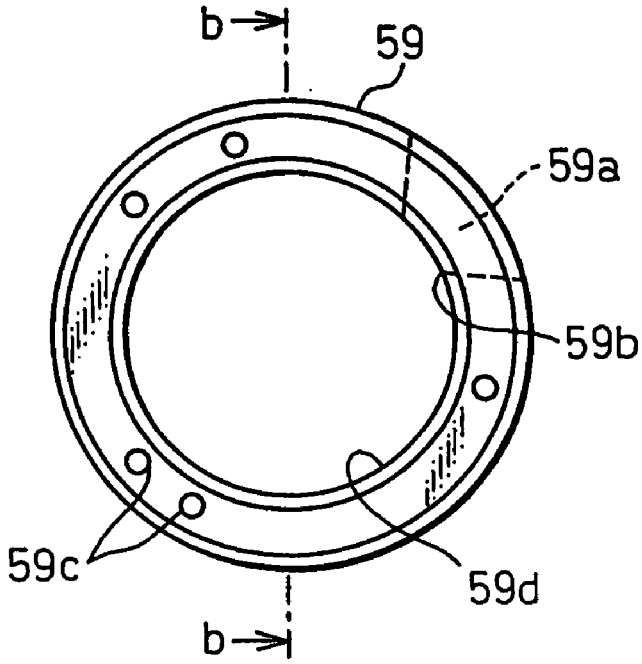
FIG. 9*a* is a front view of a scraper in an embodiment of an automatic releasing-type rolling head for forming a tapered thread on a pipe according to the present invention.
Figure 9B:
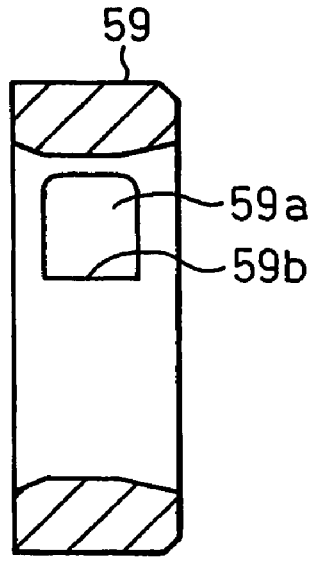
FIG. 9*b* is a sectional view taken along the line b-b in FIG. 9*a*.
Figure 10:
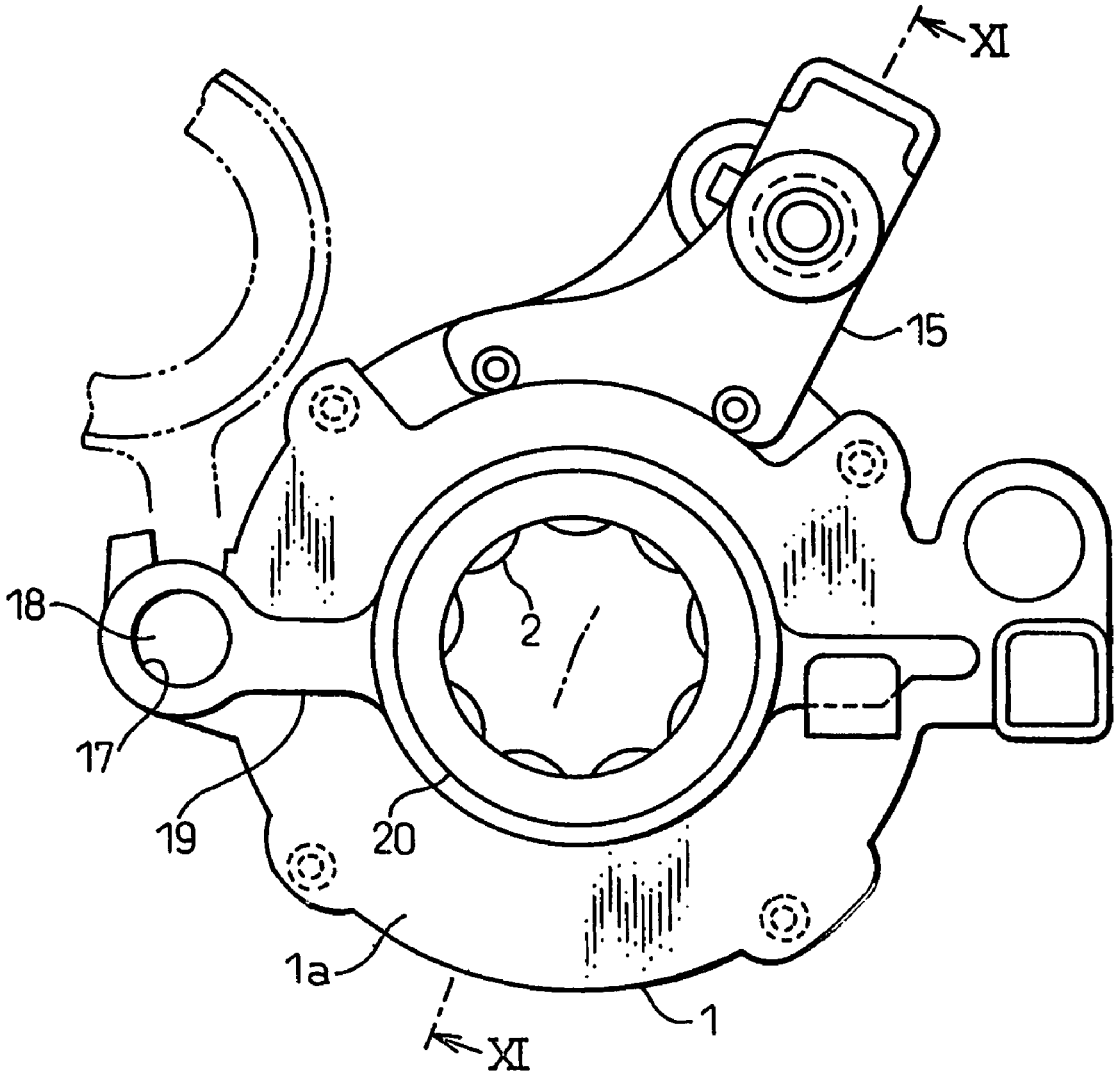
Fig.10 PRIOR ART
FIG. 10 is a front view of an example of a conventional rolling head for forming a tapered thread on a pipe.
Figure 11:
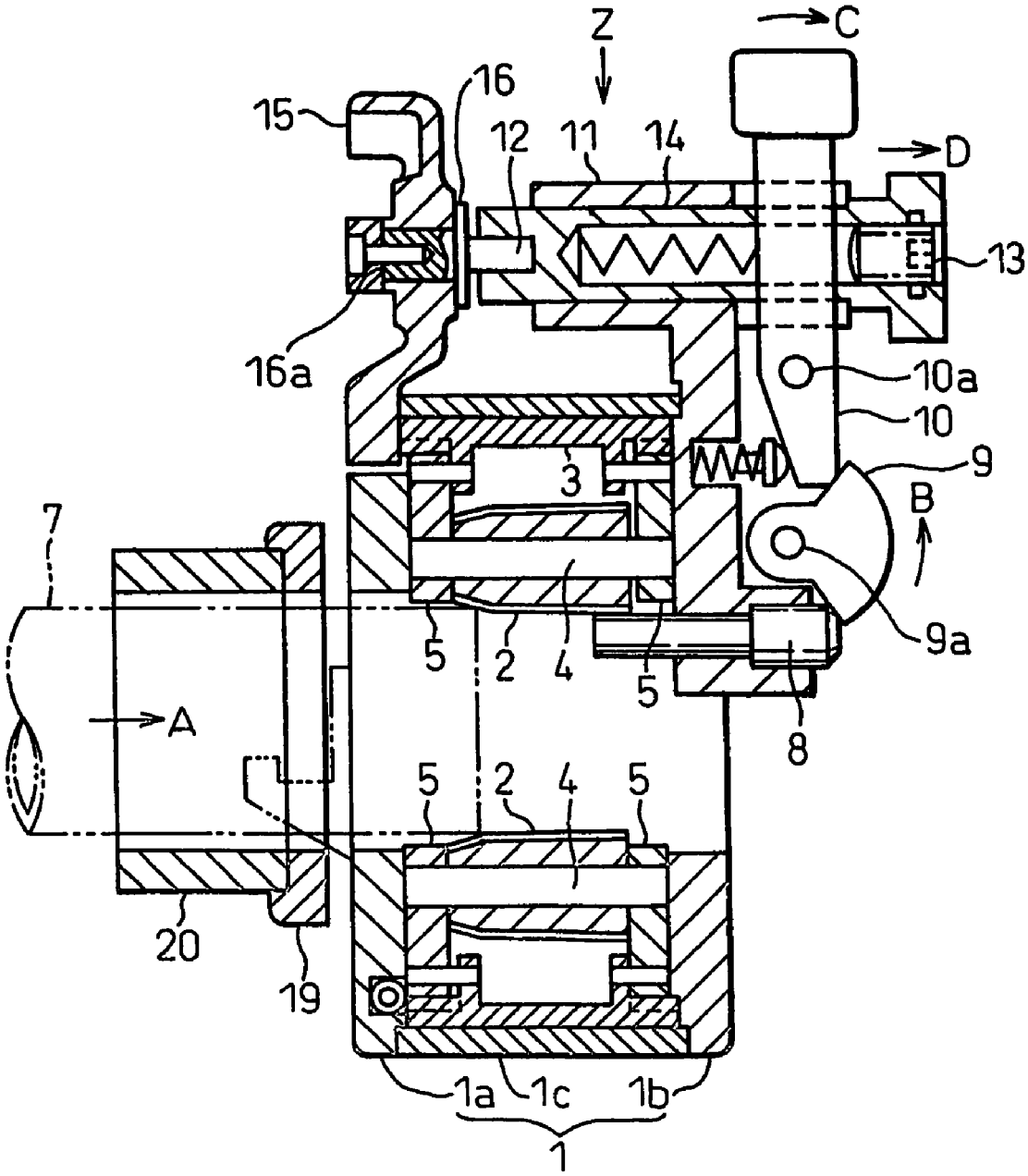
Fig.11 PRIOR ART
FIG. 11 is a sectional view taken along the line XI-XI in FIG. 10.
Figure 12:
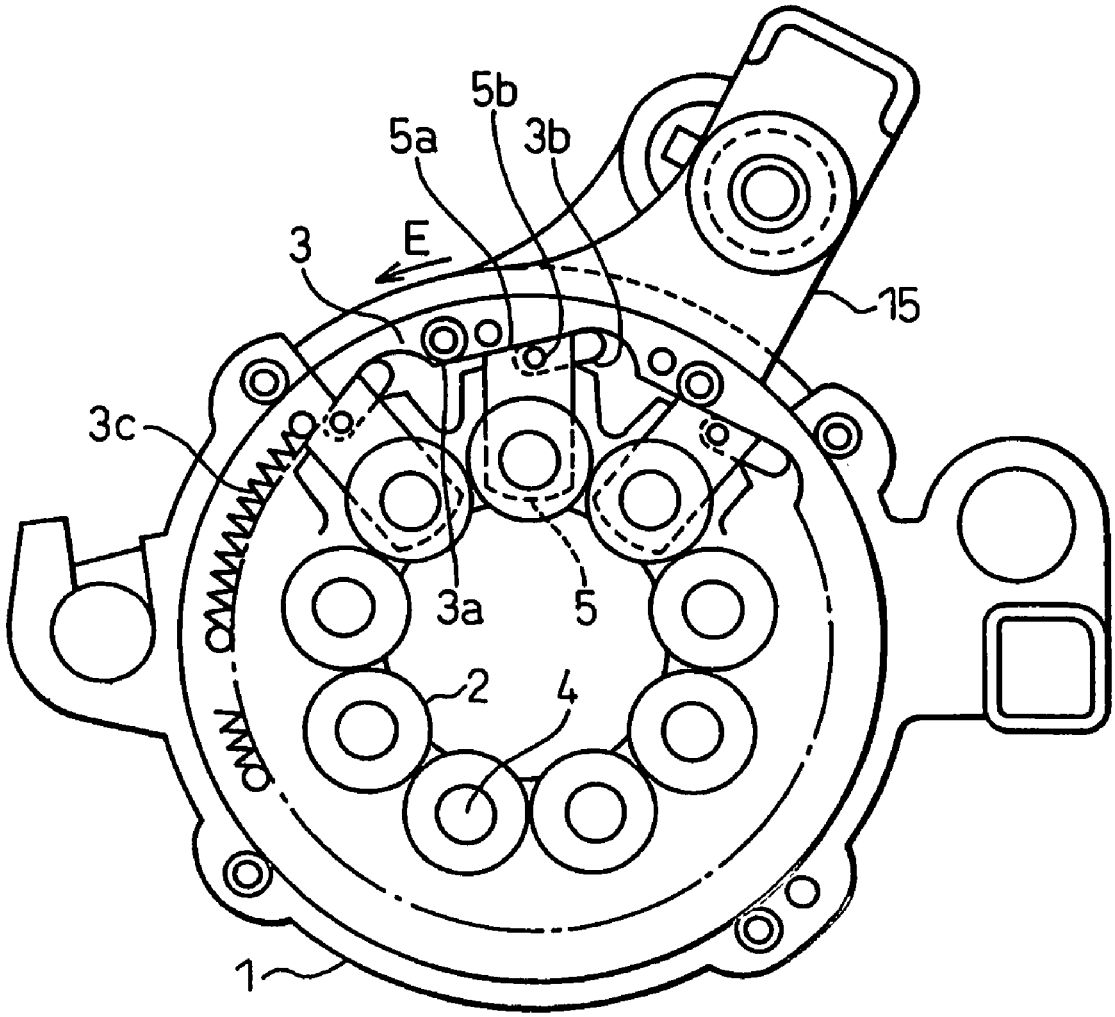
Fig.12 PRIOR ART
FIG. 12 shows an internal structure of an example of a conventional rolling head for forming a tapered thread on a pipe.

As shown in FIG. 9, the scraper 59 is in the form of a ring made of a high-strength material such as a tool steel. The inner diameter of the ring is substantially identical to the outer diameter of the to-be-rolled pipe to be scraped. The scraper 59 is provided with a square hole 59*a* which extends from the outer periphery to the inner periphery thereof. A cutting blade 59*b* for cutting the outer diameter portion of the to-be-rolled pipe is provided on one side of the square hole 59*a*. The annular scraper 59 has a plurality of threaded holes 59*c* in the side surface so that the scraper 59 can be secured to the scraper holder 58 by screws screw-engaged in the threaded holes. In the state shown in FIG. 2, the outer diameter portion of the to-be-rolled pipe can be cut while being guided in the inner diameter portion of the scraper 59. After the scraping operation ends, the scraper 59 can be moved and retracted so as not to interfere with the thread rolling operation.

The mechanism for cutting an outer diameter of a to-be-rolled pipe in this embodiment, constructed as above, is simple and can be inexpensively manufactured because the cutting blade and the to-be-rolled pipe guiding part, of the scraper 59, can be made integral. Unlike a mechanism in which the cutting blade is separate, in the mechanism of this embodiment, neither a position adjustment of the cutting blade nor a maintenance thereof are necessary. As the inner diameter portion for guiding the to-be-rolled pipe is made of the same high-strength material as that of the cutting blade, the guiding inner diameter portion is less subject to wear.

According to the automatic releasing-type rolling head for forming a tapered thread on a pipe of the present invention, during the thread rolling operation, through the shaft bearing plates, the rolling load acting on the thread rolling rollers is absorbed by the cam oblique surfaces of the cam member moving in association with the cam ring, so that the rolling load can be reduced due to the contact friction resistance of the oblique surfaces. Consequently, the necessary strength of the components which constitute the rolling head can be reduced, thus leading to reductions in weight and cost.

In addition to the reduction of the rolling load during the rolling operation, the thread rolling rollers are gradually moved away from the to-be-rolled pipe at the end of the thread rolling operation, so as to alleviate the shock generated at that time, thus leading to reduction in weight and cost.

The positions and the angles of the grooves radially provided on the front and rear closures of the housing are uniform, and the thread rolling rollers are supported in a position and at an angle corresponding to the lead angle of the thread of the to-be-rolled pipe, in the shaft bearing holes deviated in the width direction of the shaft bearing plates, so that the manufacturing cost can be reduced. Even if the thread automatic rolling roller retracting mechanism fails to operate, for some reason, after the thread rolling is finished, the thread automatic rolling roller retracting mechanism is not damaged. The structure in which the pins are provided on the shaft bearing plates can be made small. Foreign matter produced during the thread rolling operation can be discharged from the housing.

The invention claimed is:

1. An automatic releasing-type rolling head for forming a tapered thread on a pipe, comprising:

a cylindrical housing with a front closure and a rear closure;

a plurality of shaft bearing plates that are configured to be slidably supported in a plurality of guide grooves radially provided on inner surfaces of the front and the rear closures of the housing, said shaft bearing plates being provided on their outer surfaces in the radial directions with a plurality of oblique surfaces;

a plurality of thread rolling rollers configured so as to be rotatably supported by the shaft bearing plates through a plurality of roller shafts;

a cam ring configured to rotate in the housing and having a plurality of cam oblique surfaces configured so as to be opposed to the oblique surfaces of the shaft bearing plates;

a lever that is configured to abut, at its oblique surface, against a cam member, the lever being configured for preventing a movement of the cam member in association with the cam ring; and an abutment member configured so as to be pressed and moved by a thread-rolled pipe, wherein the rolling load that acts on the rolling rollers during a thread-rolling operation is configured so as to be reduced due to contact friction when transferring the rolling load to the cam oblique surface of the cam member and to the oblique surface of the lever;

wherein when the to-be-rolled pipe is configured to be thread-rolled to a predetermined length, the oblique surface of the lever is configured to be gradually moved away from the cam member moving in association with the cam ring, in association with the movement of the abutment member;

wherein the cam ring is configured to rotate due to the rolling load so that the shaft bearing plates and the thread rolling rollers are configured to move in a radial direction and an outward direction and are configured for releasing from the to-be-rolled pipe.

2. The automatic releasing-type tapered thread rolling head of claim 1, wherein a plurality of radial guide grooves, whose bottoms are configured parallel to a plane perpendicular to the axis, are provided in the inner surface of the front closure of the housing;

a plurality of guide grooves identical in dimension to the guide grooves of the front closure, are provided in the inner surface of the rear closure;

wherein the shaft bearing plates are provided with a plurality of shaft bearing holes for supporting the roller shafts;

wherein the roller shafts are configured for being slidably fitted in the guide grooves of the front closure and the rear closure and are configured for being inserted in the center holes of the discontinuous circumferential groove type rolling rollers;

wherein said shaft bearing holes are configured for being adapted to support the discontinuous circumferential groove type rolling rollers;

wherein said shaft bearing holes are configured so as to be deviated in the direction of the width of the guide grooves of the front closure or the rear closure; wherein said shaft bearing holes are configured at an angle corresponding to the lead angle of the thread of the to-be-rolled pipe.

3. The automatic releasing-type tapered thread rolling head of claim 1, wherein the shaft bearing plates are configured to rotatably support the thread rolling rollers;

wherein said shaft bearing plates have projections, integral therewith that are configured to extend in the axial direction of the thread rolling rollers, in the vicinity of the outer oblique surfaces that are brought into contact with the cam oblique surfaces of the cam ring;

wherein the surfaces of the projections that are located opposite to the oblique surfaces are configured in parallel with the oblique surfaces and are configured, at the lower portions, to have surfaces that are configured in parallel with the width direction of the shaft bearing plates;

wherein pins are provided in the vicinity of the cam oblique surfaces of the cam ring so that the projections are configured to be engaged by the pins.

4. The automatic releasing-type tapered thread rolling head of claim 1, wherein the portion of the abutment member pressed and moved by the thread-rolled pipe is configured so as to abut against the to-be-rolled pipe, wherein the portion of the abutment member has a circular contour configured to enable the abutment member to contact the front end surface of the to-be-rolled pipe substantially over the entire periphery.

5. The automatic releasing-type tapered thread rolling head of in claim 1, wherein a first set of foreign matter discharge holes is configured so as to be in the vicinity of the cam oblique surfaces of the cam ring;

wherein the first set of foreign matter discharge holes are configured so as to rotate in the housing;

wherein the first set of foreign matter discharge holes are configured for being brought into contact with the oblique heads of the shaft bearing plates to support the thread rolling rollers; and wherein the second set of foreign matter discharge holes, which are configured to be connected to the first set of foreign matter discharge holes of the cam ring are configured inside the housing.

6. The automatic open type tapered thread rolling head of claim 1, further comprising;

a buffer arm that is configured for receiving the abutment member or a member moving therewith, wherein the receiving of the abutment is configured at an appropriate distance in an axial direction;

wherein when the to-be-rolled pipe is configured for thread rolling to a predetermined length by the thread rolling rollers and the thread rolling rollers are configured for moving in the outward and radial directions, the thread rollers are configured for release from the pipe;

wherein said buffer arm is configured for detaching;

wherein said buffer arm is configured for preventing damage to an apparatus body if the to-be-rolled pipe continues moving in the axial direction, due to failure of the movement of the thread rolling rollers away from the to-be-rolled pipe.

7. The automatic open type tapered thread rolling head of claim 1, wherein a scraper for cutting the outer diameter portion of the to-be-rolled pipe is configured to be movably provided at an insertion opening of the housing for the to-be-rolled pipe, said scraper being provided with a cutting blade and an inner diameter portion, for guiding the to-be-rolled pipe, which are integrally molded.

* * * * *